US010971046B2

(12) United States Patent
Lee et al.

(10) Patent No.: US 10,971,046 B2
(45) Date of Patent: Apr. 6, 2021

(54) DISPLAY DEVICE, POWER SUPPLY DEVICE FOR DISPLAY DEVICE, AND DRIVING METHOD OF DISPLAY DEVICE

(71) Applicant: SAMSUNG DISPLAY CO., LTD., Yongin-si (KR)

(72) Inventors: Sang Hyun Lee, Seongnam-si (KR); Myeong Su Kim, Hwaseong-si (KR); Bo Yeon Kim, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/511,659

(22) Filed: Jul. 15, 2019

(65) Prior Publication Data

US 2020/0111398 A1 Apr. 9, 2020

(30) Foreign Application Priority Data

Oct. 8, 2018 (KR) ..... 10-2018-0120056

(51) Int. Cl.
*G09G 3/20* (2006.01)

(52) U.S. Cl.
CPC ..... *G09G 3/20* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 6,157,182 | A * | 12/2000 | Tanaka | H02M 3/156 323/284 |
| 7,061,213 | B2 * | 6/2006 | Yoshida | H02M 3/156 323/224 |
| 2008/0224674 | A1 * | 9/2008 | Hasegawa | H02M 3/158 323/271 |
| 2009/0033305 | A1 * | 2/2009 | Hane | H02M 3/156 323/288 |
| 2009/0315523 | A1 * | 12/2009 | Kumagai | H02M 3/156 323/272 |

(Continued)

FOREIGN PATENT DOCUMENTS

| | | |
|---|---|---|
| KR | 10-1142468 | 4/2012 |
| KR | 10-2014-0055087 | 5/2014 |

(Continued)

*Primary Examiner* — Dorothy Harris
(74) *Attorney, Agent, or Firm* — F. Chau & Associates, LLC

(57) ABSTRACT

A display device includes a display unit including a plurality of pixels, a scan driver applying a scan signal to a plurality of scan lines, a data driver applying a data signal to a plurality of data lines, and a power supply unit supplying a driving voltage to at least one among the display unit, the scan driver, and the data driver. The power supply unit includes an inductor connected between an input terminal to which an input voltage is input and a driving voltage output terminal to which the driving voltage is output, a switch connected between the inductor and a ground, and a switch controller outputting a first ramp pulse having a first frequency at a first load of the display device and outputting a second ramp pulse having a second frequency at a second load of the display device.

11 Claims, 8 Drawing Sheets

(56) References Cited

U.S. PATENT DOCUMENTS

| | | | | |
|---|---|---|---|---|
| 2011/0025673 | A1* | 2/2011 | Chen | H02M 3/156 345/211 |
| 2015/0116300 | A1* | 4/2015 | Yamaki | G02F 1/1368 345/212 |
| 2015/0179098 | A1* | 6/2015 | Kuang | H05B 33/00 345/211 |
| 2015/0206497 | A1* | 7/2015 | Choi | G09G 3/3648 345/212 |
| 2017/0373596 | A1* | 12/2017 | Huang | H02M 3/158 |
| 2018/0123440 | A1 | 5/2018 | Lee et al. | |

FOREIGN PATENT DOCUMENTS

| | | |
|---|---|---|
| KR | 1-2015-0120187 | 10/2015 |
| KR | 10-2017-0021943 | 3/2017 |

* cited by examiner

DISPLAY DEVICE, POWER SUPPLY DEVICE FOR DISPLAY DEVICE, AND DRIVING METHOD OF DISPLAY DEVICE

CROSS-REFERENCE TO RELATED APPLICATION

This application claims priority under 35 U.S.C. § 119 to Korean Patent Application No. 10-2018-0120056, filed in the Korean Intellectual Property Office on Oct. 8, 2018, the disclosure of which is incorporated by reference herein in its entirety.

TECHNICAL FIELD

Exemplary embodiments of the inventive concept relate to a display device, a power supply device for the display device, and a driving method of the display device. More particularly, exemplary embodiments of the inventive concept relate to a display device, a power supply device for the display device, and a driving method of the display device for more effectively generating a driving voltage.

DISCUSSION OF RELATED ART

A display device includes a DC-DC converter that converts power supplied from the outside to generate a driving voltage for driving the display device. The DC-DC converter must be able to generate a stable driving voltage through a predetermined voltage.

In general, the DC-DC converter repeatedly turns a switch on and off with a predetermined frequency to generate a predetermined driving voltage. This predetermined frequency is referred to as a switching frequency. At each time that the switch turns on and off, a power loss occurs during a rising time and a falling time of a current and a voltage flowing through the switch. This power loss is proportional to the switching frequency of the switch.

The display device does not always operate with a constant load. The load of a display device may vary according to frame units that represent an image. For example, the display device may operate with a heavy load while the image is displayed in one frame, and the display device may operate with a light load while the displayed image for the one frame is reset so that the image is not displayed. When the DC-DC converter generates the driving voltage with a constant switching frequency irrespective of the load of the display device, unnecessary power loss may occur, and then the efficiency of the DC-DC converter may deteriorate and heat generation may be increased.

SUMMARY

According to an exemplary embodiment of the inventive concept, a display device includes a display unit including a plurality of pixels, a scan driver applying a scan signal to a plurality of scan lines connected to the plurality of pixels, a data driver applying a data signal to a plurality of data lines connected to the plurality of pixels, and a power supply unit supplying a driving voltage to at least one among the display unit, the scan driver, and the data driver. The power supply unit includes an inductor connected between an input terminal to which an input voltage is input and a driving voltage output terminal to which the driving voltage is output, a switch connected between the inductor and a ground, and a switch controller outputting a first ramp pulse having a first frequency at a first load of the display device and outputting a second ramp pulse having a second frequency at a second load of the display device to control a switching operation of the switch.

The switch controller may include a pulse generator receiving a current flowing through the switch and outputting a ramp pulse having a frequency corresponding to the received current.

The pulse generator may compare the received current with a plurality of reference values to select a reference value corresponding to the received current, and output the ramp pulse having a frequency corresponding to the selected reference value.

The switch controller may further include: a current measuring unit measuring a current flowing through the switch and outputting a voltage corresponding to the measured current; and an adder adding the voltage output from the current measuring unit to the ramp pulse output from the pulse generator.

A frame in which one image is displayed may include a writing-in period in which a data signal is input to the plurality of pixels, a light emission period in which the plurality of pixels are emitted, and a reset period in which the plurality of pixels are reset, the display device may have the first load during an activation section including the writing-in period and the light emission period, and the display device may have the second load during a blank section including the reset period.

When the display device has a third load that is smaller than the first load and is larger than the second load during the activation section, the switch controller may output a third ramp pulse having a third frequency that is higher than the first frequency and is lower than the second frequency to control the switching operation of the switch.

The switch controller may include a pulse generator receiving a current flowing to the driving voltage output terminal and outputting a ramp pulse having a frequency corresponding to the received current.

The switch controller may include: a current measuring unit measuring a current flowing through the switch and outputting a voltage corresponding to the measured current; and a pulse generator receiving the voltage output from the current measuring unit and outputting a ramp pulse having a frequency corresponding to the received voltage.

The switch controller may include a pulse generator receiving a vertical synchronization signal dividing an image into frame units, outputting the first ramp pulse during a predetermined first section from a time that the vertical synchronization signal is received as an on voltage, and outputting the second ramp pulse during a predetermined second section next to the predetermined first section.

According to an exemplary embodiment of the inventive concept, a power supply device for a display device includes, an inductor connected between an input terminal to which an input voltage is input and a driving voltage output terminal to which a driving voltage is output, a switch connected between the inductor and a ground, and a switch controller controlling a switching operation of the switch. The switch controller outputs a first ramp pulse having a first frequency to control the switching operation of the switch during an activation section including a writing-in period in which a data signal is input to a plurality of pixels and a light emission period in which the plurality of pixels are emitted in a frame in which the display device displays one image, the switch controller outputs a second ramp pulse having a second frequency to control the switching operation of the switch during a blank section including a reset period in which the plurality of pixels are reset in the frame, and the first frequency is lower than the second frequency.

The switch controller may include a pulse generator receiving a current flowing through the switch and outputting a ramp pulse having a frequency corresponding to the received current.

The switch controller may include a current measuring unit measuring a current flowing through the switch and outputting a voltage corresponding to the measured current, and an adder adding the voltage output from the current measuring unit to the ramp pulse output from the pulse generator.

The switch controller may include a pulse generator receiving a current flowing to the driving voltage output terminal and outputting a ramp pulse having a frequency corresponding to the received current.

The switch controller may include a current measuring unit measuring a current flowing through the switch and outputting a voltage corresponding to the measured current, and a pulse generator receiving the voltage output from the current measuring unit and outputting the ramp pulse having a frequency corresponding to the received voltage.

The switch controller may include a pulse generator receiving a vertical synchronization signal dividing an image into frame units, outputting the first ramp pulse during a predetermined first section from a time that the vertical synchronization signal is received as an on voltage, and outputting the second ramp pulse during a predetermined second section next to the predetermined first section.

According to an exemplary embodiment of the inventive concept, for a driving method of a display device, the display device includes a power supply unit including an inductor connected between an input terminal to which an input voltage is input and a driving voltage output terminal to which a driving voltage is output, a switch connected between the inductor and a ground, and a switch controller controlling a switching operation of the switch. The driving method includes inputting a data signal to a plurality of pixels during a writing-in period, emitting the plurality of pixels with a brightness corresponding to the input data signal during a light emission period, and resetting the plurality of pixels during a reset period. The switch controller outputs a first ramp pulse having a first frequency to control the switching operation of the switch during an activation section including the writing-in period and the light emission period, the switch controller outputs a second ramp pulse having a second frequency to control the switching operation of the switch during a blank section including the reset period, and the first frequency is lower than the second frequency.

The switch controller may receive a current flowing through the switch and output a ramp pulse having a frequency corresponding to the received current.

The switch controller may receive a current flowing to the driving voltage output terminal and output a ramp pulse having a frequency corresponding to the received current.

The switch controller may measure a current flowing through the switch, output a voltage corresponding to the measured current, and output a ramp pulse having a frequency corresponding to the output voltage.

The switch controller may receive a vertical synchronization signal dividing an image into frame units, output the first ramp pulse during a predetermined first section from a time that the vertical synchronization signal is received as an on voltage, and output the second ramp pulse during a predetermined second section next to the predetermined first section.

DETAILED DESCRIPTION OF THE EMBODIMENTS

Figure 1:
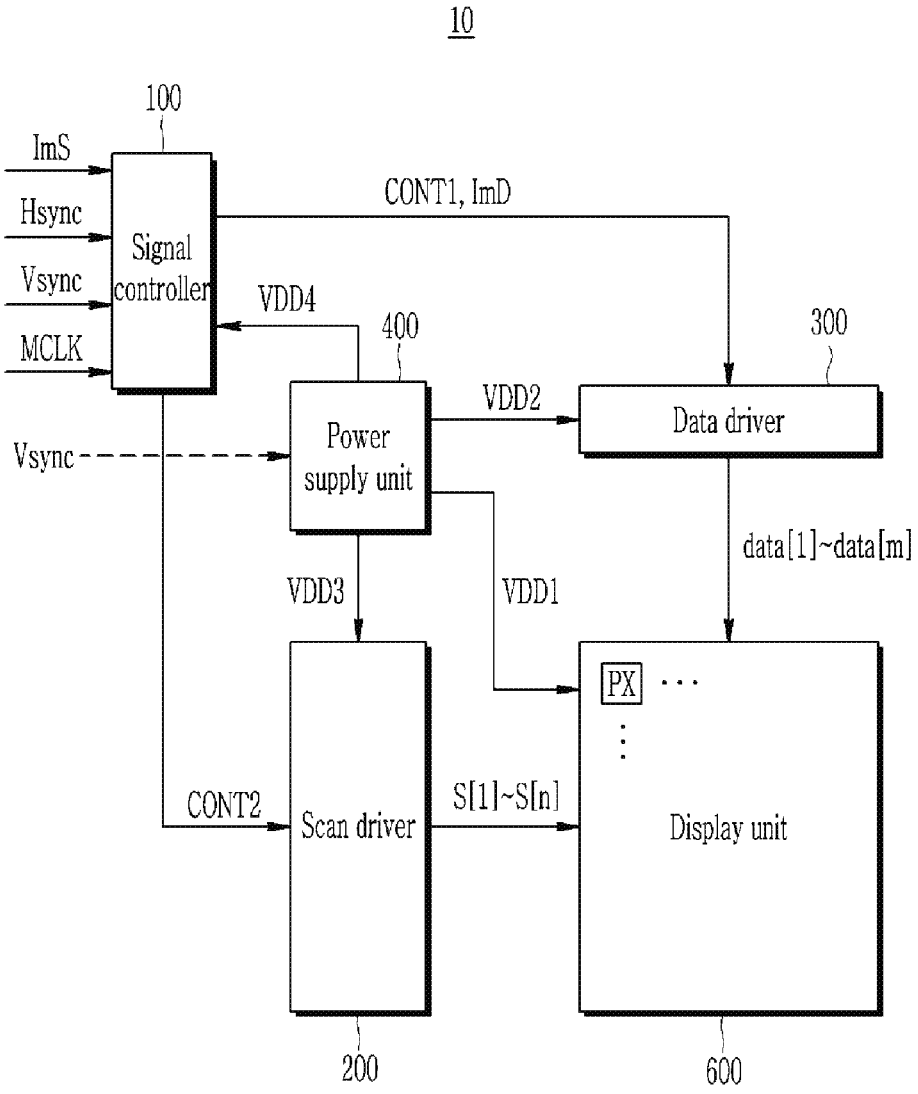
FIG. 1 is a block diagram showing a display device according to an exemplary embodiment of the inventive concept.

Exemplary embodiments of the inventive concept provide a display device, a power supply device for the display device, and a driving method of the display device for more effectively generating a driving voltage.

Hereinafter, exemplary embodiments of the inventive concept will be described in detail with reference to the accompanying drawings. Like reference numerals may refer to like elements throughout this application.

FIG. 1 is a block diagram showing a display device according to an exemplary embodiment of the inventive concept.

Referring to FIG. 1, a display device 10 includes a signal controller 100, a scan driver 200, a data driver 300, a power supply unit 400, and a display unit 600.

The signal controller 100 receives an input image signal ImS and a synchronization signal from an external device. The input image signal ImS includes luminance information of a plurality of pixels PX. The luminance has a gray level of a predetermined number, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates a first driving control signal CONT1, a second driving control signal CONT2, and an image data signal ImD based on the image signal ImS, the horizontal synchronization signal Hsync, the vertical synchronization signal Vsync, and the main clock signal MCLK.

The signal controller 100 divides the image signal ImS into frame units based on the vertical synchronization signal Vsync, and divides the image signal ImS into scan line units based on the horizontal synchronization signal Hsync to generate the image data signal ImD. The signal controller 100 transmits the image data signal ImD to the data driver 300 along with the first driving control signal CONT1.

The display unit 600 is a display area including the plurality of pixels PX. The display unit 600 includes a plurality of scan lines connected to the plurality of pixels PX, a plurality of data lines connected to the plurality of pixels PX, and a plurality of power lines connected to the plurality of pixels PX. The plurality of scan lines may extend approximately in the row direction and be approximately parallel to one another. A plurality of data lines may extend approximately in a column direction and be approximately parallel to one another. The plurality of pixels PX may be arranged in a form of a matrix in intersecting regions of the plurality of scan lines and the plurality of data lines.

The scan driver 200 is connected to the plurality of scan lines, and generates a plurality of scan signals S[1]-S[n] according to the second driving control signal CONT2. The scan driver 200 may sequentially apply the scan signals S[1]-S[n] having a gate-on voltage to the plurality of scan lines.

The data driver 300 is connected to the plurality of data lines, samples and holds the image data signal ImD according to the first driving control signal CONT1, and applies a plurality of data signals data[1]-data[m] to the plurality of data lines. The data driver 300 applies the data signals data[1]-data[m] having a predetermined voltage range to the plurality of data lines in correspondence with the scan signals S[1]-S [n] having the gate-on voltage.

The power supply unit 400 supplies a first driving voltage VDD1 to the display unit 600. The first driving voltage VDD1 is supplied to the power line connected to the plurality of pixels PX to provide a driving current for the emission of the plurality of pixels PX. The power supply unit 400 may supply a second driving voltage VDD2 to the data driver 300. The second driving voltage VDD2 having a voltage for the operation of the data driver 300 may be used as a source power for the data signals data[1]-data[m]. The power supply unit 400 may supply a third driving voltage VDD3 to the scan driver 200. The third driving voltage VDD3 having the voltage for the operation of the scan driver 200 may be used as a power voltage to generate the scan signals S[1]-S[n] having the gate-on voltage. The power supply unit 400 may supply a fourth driving voltage VDD4 to the signal controller 100. The fourth driving voltage VDD4 may be used as a voltage for operation of the signal controller 100. The display unit 600, the data driver 300, the scan driver 200, the signal controller 100, and the like may be loads of the power supply unit 400. As such, the power supply unit 400 may be a power supply device that provides the overall power for driving the display device 10.

Figure 2:
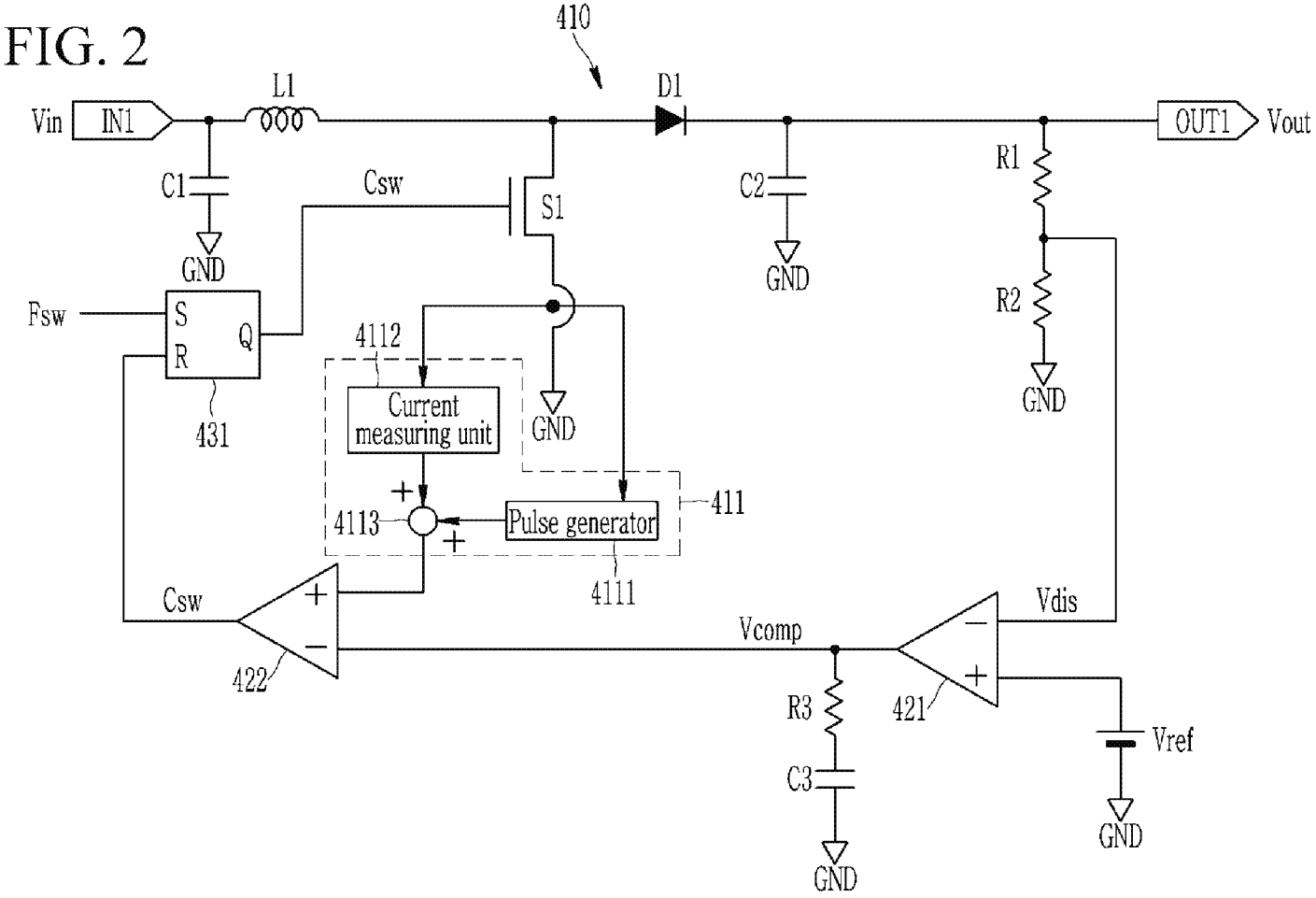
FIG. 2 is a view showing a driving voltage generator according to an exemplary embodiment of the inventive concept.
Figure 6:
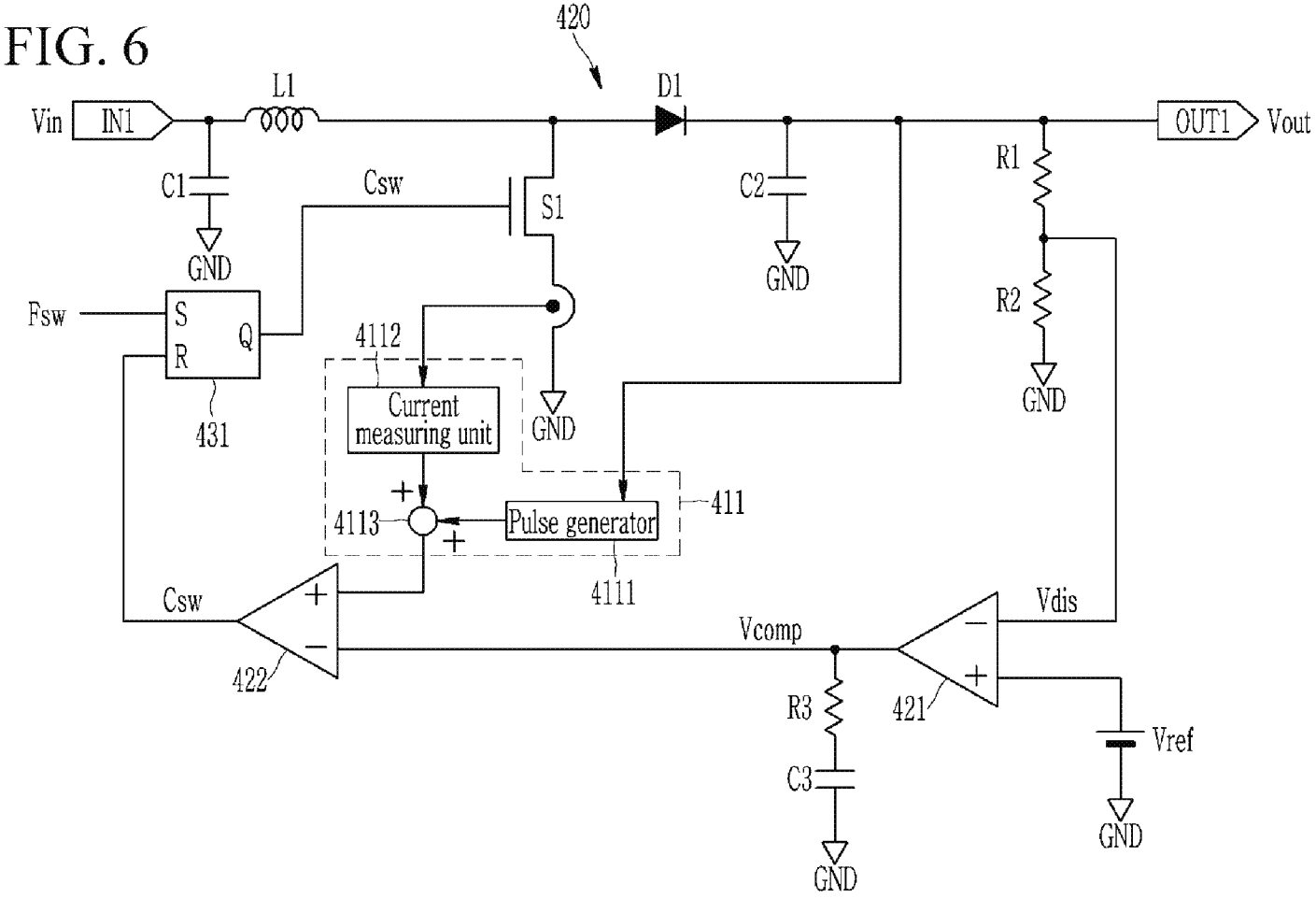
FIG. 6 is a view showing a driving voltage generator according to an exemplary embodiment of the inventive concept.
Figure 7:
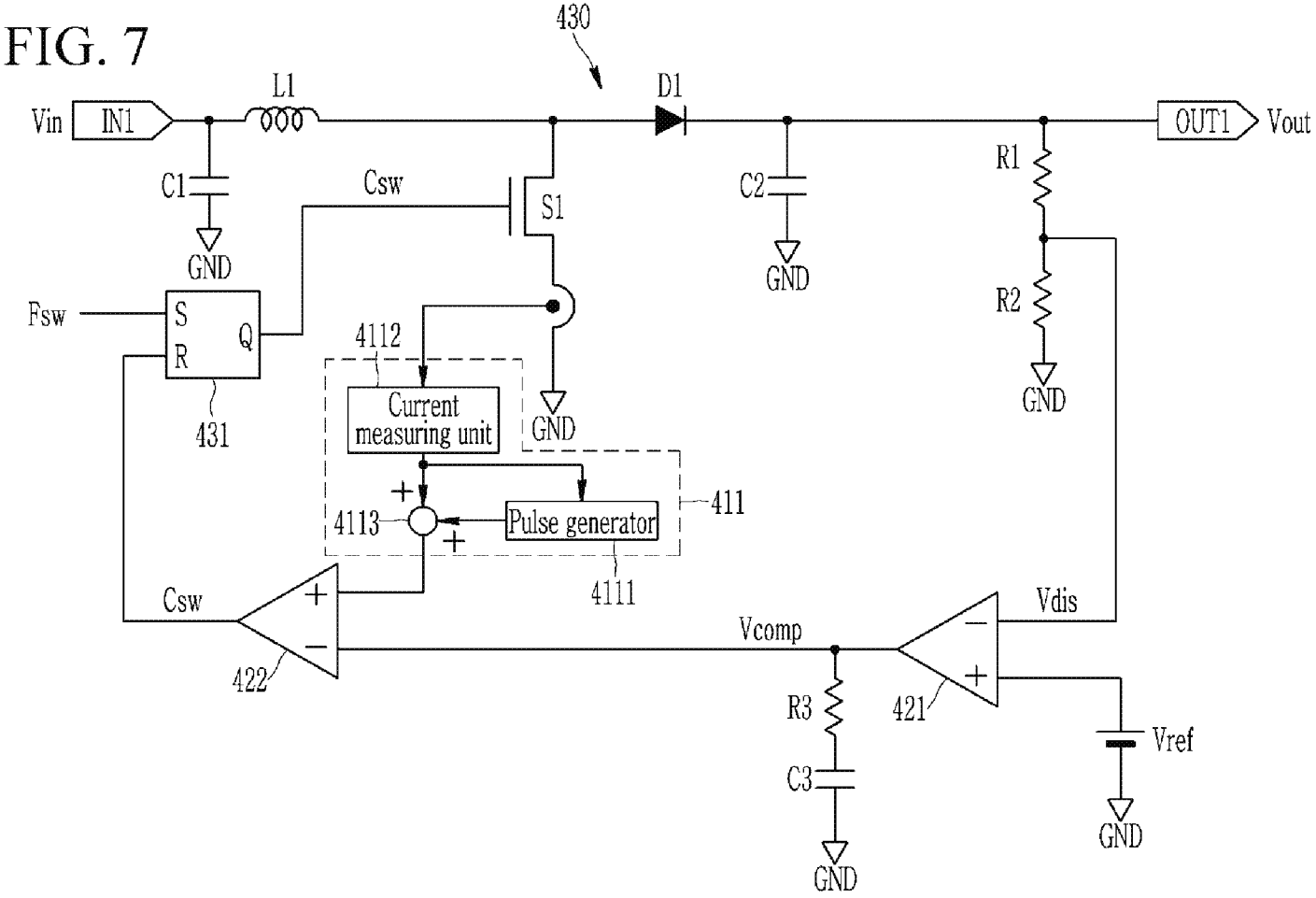
FIG. 7 is a view showing a driving voltage generator according to an exemplary embodiment of the inventive concept.
Figure 8:
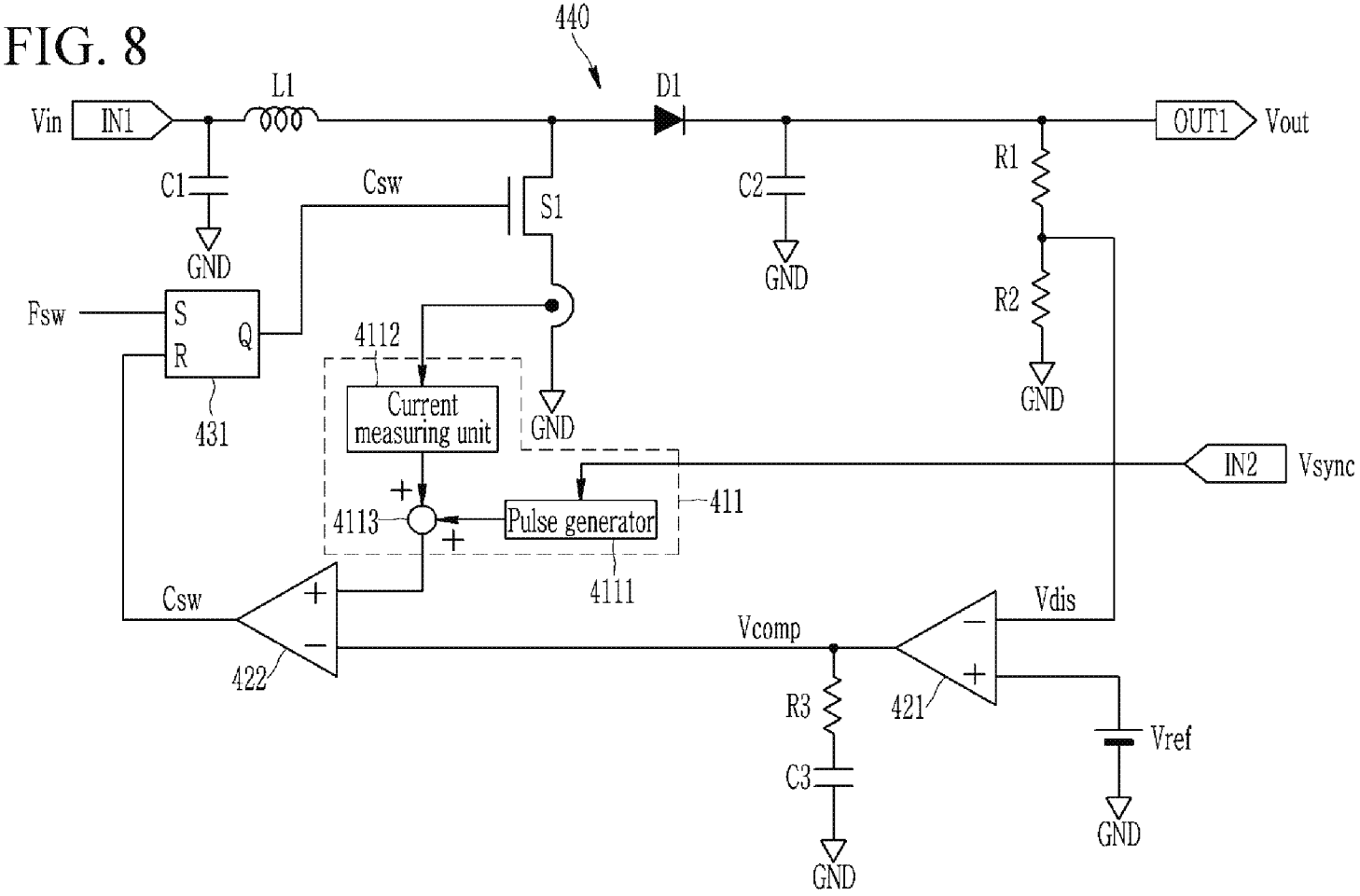
FIG. 8 is a view showing a driving voltage generator according to an exemplary embodiment of the inventive concept.

The power supply unit 400 may include at least one among a first driving voltage generator 410 of FIG. 2, a second driving voltage generator 420 of FIG. 6, a third driving voltage generator 430 of FIG. 7, or a fourth driving voltage generator 440 of FIG. 8.

FIG. 2 is a view showing a driving voltage generator according to an exemplary embodiment of the inventive concept.

Referring to FIG. 2, the first driving voltage generator 410 includes an inductor L1, a switch S1, a diode D1, a plurality of resistors R1, R2, and R3, a plurality of capacitors C1, C2, and C3, a switch controller 411, a plurality of differential amplifiers 421 and 422, and a latch unit 431.

The inductor L1 is connected between an input terminal IN1 and a driving voltage output terminal OUT1. The inductor L1 includes one terminal connected to the input terminal IN1 to which an input voltage Vin is input and the other terminal connected to a first electrode of the switch S1. The input voltage Vin may be a direct current (DC) voltage provided from an external power source. The first capacitor C1 may be connected to the input terminal IN1. The first capacitor C1 includes a first electrode connected to the input terminal IN1 and a second electrode connected to a ground GND.

The switch S1 is connected between the inductor L1 and the ground GND. The switch S1 includes a gate electrode connected to an output terminal Q of the latch unit 431, the first electrode connected to the other terminal of the inductor L1, and a second electrode connected to the ground GND. The switch S1 may be an n-channel electric field effect transistor. The gate-on voltage that turns on the n-channel electric field effect transistor is a high level voltage, and the gate-off voltage that turns it off is a low level voltage. According to an exemplary embodiment of the inventive concept, the switch S1 may be a p-channel electric field effect transistor. In this case, the gate-on voltage that turns on the p-channel electric field effect transistor is the low level voltage, and the gate-off voltage that turns it off is the high level voltage.

The diode D1 is connected between the inductor L1 and the driving voltage output terminal OUT1. The diode D1 includes a first electrode connected to the other terminal of the inductor L1 and a second electrode connected to the driving voltage output terminal OUT1. An output driving voltage Vout is output to the driving voltage output terminal OUT1. The output driving voltage Vout may be one among the first to fourth driving voltages VDD1, VDD2, VDD3, and VDD4 described above with reference to FIG. 1. The second capacitor C2 may be connected to the driving voltage output terminal OUT1. The second capacitor C2 includes a first electrode connected to the driving voltage output terminal OUT1 and a second electrode connected to the ground GND. The second capacitor C2 may stably maintain the voltage of the driving voltage output terminal OUT1.

The first resistor R1 includes one terminal connected to the driving voltage output terminal OUT1 and the other terminal connected to the second resistor R2. The second resistor R2 includes one terminal connected to the other terminal of the first resistor R1 and the other terminal connected to the ground GND. In other words, the first resistor R1 and the second resistor R2 may be coupled in series between the driving voltage output terminal OUT1 and the ground GND. The voltage corresponding to the voltage difference between the output driving voltage Vout output to the driving voltage output terminal OUT1 and the ground voltage is distributed to the first resistor R1 and the second resistor R2. A distribution voltage Vdis between the first resistor R1 and the second resistor R2 has the voltage value between the output driving voltage Vout and the ground voltage according to the resistance of the first resistor R1 and the second resistor R2.

The first differential amplifier 421 includes a first input terminal (−), a second input terminal (+), and an output terminal. The distribution voltage Vdis is input to the first input terminal (−) of the first differential amplifier 421, and a reference voltage Vref is input to the second input terminal (+). The reference voltage Vref may be a predetermined voltage for compensating an error of the output driving voltage Vout. The voltage difference between the distribution voltage Vdis and the reference voltage Vref is amplified by a constant gain and output as a compensation voltage Vcomp from the output terminal of the first differential amplifier 421.

The third capacitor C3 is connected between the output terminal of the first differential amplifier 421 and the ground GND, and the third resistor R3 is connected between the output terminal of the first differential amplifier 421 and the third capacitor C3.

The switch controller 411 includes a pulse generator 4111, a current measuring unit 4112, and an adder 4113.

Figure 3:
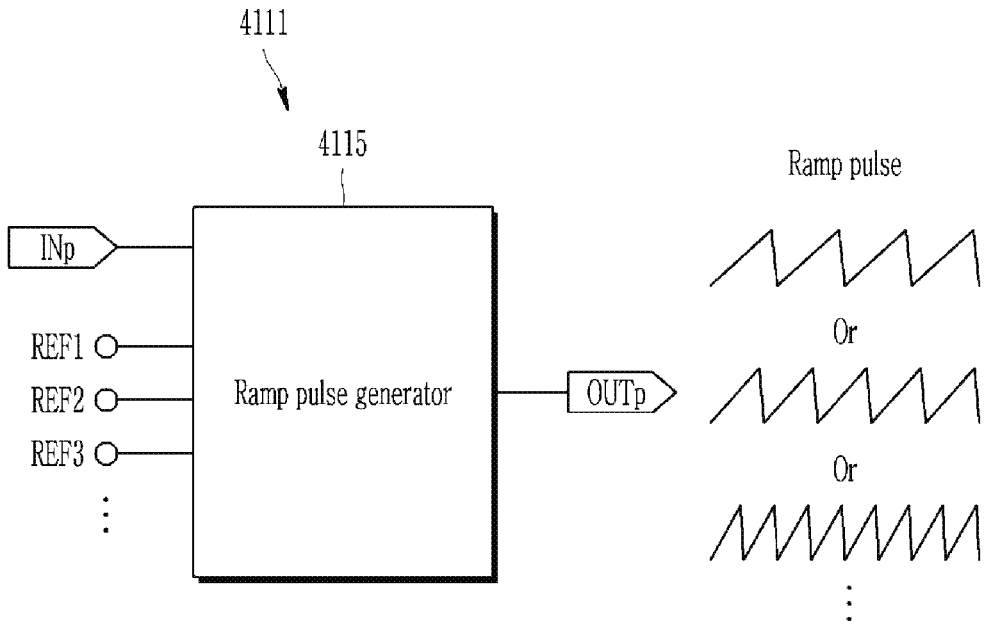
FIG. 3 is a view showing a pulse generator according to an exemplary embodiment of the inventive concept.

The pulse generator 4111 is described with reference to FIG. 3. FIG. 3 is a view showing a pulse generator according to an exemplary embodiment of the inventive concept.

Referring to FIG. 3, the pulse generator 4111 includes a ramp pulse generator 4115. The ramp pulse generator 4115 includes an input terminal INp and an output terminal OUTp. The ramp pulse generator 4115 receives a current or voltage at the input terminal INp and outputs a ramp pulse at the output terminal OUTp. The ramp pulse generator 4115 compares the value of the current or voltage input to the input terminal INp with a plurality of reference values REF1, REF2, REF3, . . . that are predetermined. The ramp pulse generator 4115 may output a plurality of ramp pulses having different frequencies, which correspond to the plurality of reference values REF1, REF2, REF3, . . . . In other words, the ramp pulse generator 4115 selects a reference value corresponding to the input current or voltage, and may output a ramp pulse having a frequency corresponding to the selected reference value among the plurality of ramp pulses. A ramp pulse can have a sawtooth wave form in which a change, at which the voltage (or current) increases linearly with time and suddenly decreases when it reaches a certain magnitude to return to its original value, is repeated.

The ramp pulse generator 4115 may output the ramp pulse having a relatively low frequency when the value of the current or voltage input to the input terminal INp is high, and may output the ramp pulse having a relatively high frequency when the value of the current or voltage input to the input terminal INp is low. For example, the ramp pulse generator 4115 may receive the current flowing to the input terminal INp through the switch S1. When the first reference value REF1 is larger than the second reference value REF2 and the second reference value REF2 is larger than the third reference value REF3, the ramp pulse generator 4115 may output the ramp pulse having a low frequency if the first reference value REF1 is selected, may output the ramp pulse having a high frequency if the third reference value REF3 is selected, and may output the ramp pulse having a middle frequency if the second reference value REF2 is selected.

For example, the low frequency may be referred to as a first frequency, the high frequency may be referred to as a second frequency, and the middle frequency may be referred to as a third frequency. In other words, the first frequency is lower than the second frequency. The third frequency is higher than the first frequency and lower than the second frequency.

Referring again to FIG. 2, the pulse generator 4111 receives the current flowing to the switch S1. In other words, the pulse generator 4111 may receive the current flowing through the inductor L1 and the switch S1 from the input terminal IN1. The current flowing through the switch S1 is received at the input terminal INp of the ramp pulse generator 4115 of FIG. 3. The pulse generator 4111 may compare the current flowing through the switch S1 with the plurality of reference values REF1, REF2, REF3, . . . to select the reference value corresponding to the received current, and may output the ramp pulse, having the frequency corresponding to the selected reference value, to the adder 4113.

The current measuring unit 4112 measures the current through the switch S1 and outputs a voltage corresponding to the measured current to the adder 4113.

The adder 4113 adds the voltage output from the current measuring unit 4112 to the ramp pulse output from the pulse generator 4111. The adder 4113 outputs the ramp pulse, of which the voltage output from the current measuring unit 4112 is added to the ramp pulse output from the pulse generator 4111, to the second differential amplifier 422.

The second differential amplifier 422 includes a first input terminal (−), a second input terminal (+), and an output terminal. The compensation voltage Vcomp output from the first differential amplifier 421 is input to the first input terminal (−) of the second differential amplifier 422, and the ramp pulse output from the adder 4113 is input to the second input terminal (+). The voltage difference between the ramp pulse and the compensation voltage Vcomp is amplified with a constant gain to the output terminal of the second differential amplifier 422 and output as a switch control signal Csw. The switch control signal Csw may be output in a pulse form corresponding to the voltage difference between the ramp pulse and the compensation voltage Vcomp.

The latch unit 431 includes a first input terminal S, a second input terminal R, and the output terminal Q. An output control signal Fsw is input to the first input terminal S of the latch unit 431 and the switch control signal Csw is input to the second input terminal R. The latch unit 431 may limit the output of the switch control signal Csw according to the output control signal Fsw. The switch control signal Csw is output to the output terminal Q of the latch unit 431 to be transmitted to the gate electrode of the switch S1. However, the inventive concept is not limited thereto. According to an exemplary embodiment of the inventive concept, the latch unit 431 may be omitted.

The switch control signal Csw has a switching frequency corresponding to the frequency of the ramp pulse. The switch S1 may be repeatedly turned on and off based on the switching frequency of the switch control signal Csw. When the switch S1 turns on, energy is stored in the inductor L1 as the current amount transferred to ground GND through the inductor L1 increases. When the switch S1 turns off, the current generated by the energy stored in the inductor L1 is delivered to the driving voltage output terminal OUT1 via the diode D1. The voltage of the driving voltage output terminal OUT1 increases and the energy stored in the inductor L1 decreases gradually. Again, when the switch S1 is turned on, the energy is stored in the inductor L1 and the voltage of the driving voltage output terminal OUT1 decreases.

Thus, the current amount and voltage delivered to the driving voltage output terminal OUT1 by the switch control signal Csw may be adjusted. The current amount and voltage delivered to the driving voltage output terminal OUT1 is determined by a duty of the switch S1. The duty may refer to a ratio of a turn-on time to a turn-off time of the switch S1 or a ratio of an on-time to an off-time of the switch control signal Csw. The duty of the switch S1 may be determined by the compensation voltage Vcomp output from the first differential amplifier 421.

When the output driving voltage Vout output from the driving voltage output terminal OUT1 is lower than a desired voltage, the distribution voltage Vdis decreases. As the distribution voltage Vdis decreases, the compensation voltage Vcomp output from the first differential amplifier 421 also decreases. As the compensation voltage Vcomp decreases, the on time of the switch control signal Csw, output by the voltage difference between the ramp pulse and the compensation voltage Vcomp in the second differential amplifier 422, increases. Accordingly, the duty of the switch S1 is increased and the voltage of the driving voltage output terminal OUT1 is increased.

When the output driving voltage Vout output to the driving voltage output terminal OUT1 is higher than the desired voltage, the distribution voltage Vdis increases. As the distribution voltage Vdis increases, the compensation voltage Vcomp output from the first differential amplifier 421 also increases. As the compensation voltage Vcomp increases, the on-time of the switch control signal Csw, output by the voltage difference between the ramp pulse and the compensation voltage Vcomp in the second differential amplifier 422, decreases. Accordingly, the duty of the switch S1 is reduced and the voltage of the driving voltage output terminal OUT1 is lowered.

The switch controller 411 may change the frequency of the switch control signal Csw by changing and outputting the frequency of the ramp pulse according to the value of the current flowing through the switch S1. When the value of the current flowing through the switch S1 is large (e.g., the load is large), the switch controller 411 outputs the ramp pulse having the relatively low frequency, and when the value of the current flowing through the switch S1 is small (e.g., the load is small), it outputs the ramp pulse having the relatively high frequency, thus controlling the switching operation of the switch S1. In other words, when the value of the current flowing through the switch S1 is large (e.g., the load is large), the switch controller 411 outputs the switch control signal Csw having the relatively low frequency, when the value of the current flowing through the switch S1 is small (e.g., the load is small), it outputs the switch control signal Csw having the relatively high frequency, thus controlling the switching operation of the switch S1.

Since the frequency at which the switch S1 is switched decreases when the load is large, the power loss caused due to the switching operation, in which the switch S1 is turned on and turned off, may be reduced.

The power supply unit 400 of FIG. 1 including the first driving voltage generator 410 may generate the first through fourth driving voltages VDD1, VDD2, VDD3, and VDD4 based on the operation of the display device 10. The load of the display device 10 may be changed by a frame unit representing an image. For example, the display device 10 may operate with a heavy load while the image is displayed in one frame, and the display device 10 operates with a light load by initializing the displayed image for one frame while the image is not displayed. As the power supply unit 400 outputs the ramp pulse (e.g., the switch control signal Csw) having the low frequency while the display device 10 operates with the heavy load and outputs the ramp pulse (e.g., the switch control signal Csw) having the high frequency while the display device 10 operates with the light load, the power loss may be reduced, and the first through fourth driving voltages VDD1, VDD2, VDD3, and VDD4 may be more effectively generated.

This is described with reference to FIG. 1, FIG. 4, and FIG. 5. First, a driving method of the display device according to an exemplary embodiment of the inventive concept is described with reference to FIG. 1 and FIG. 4.

Figure 4:
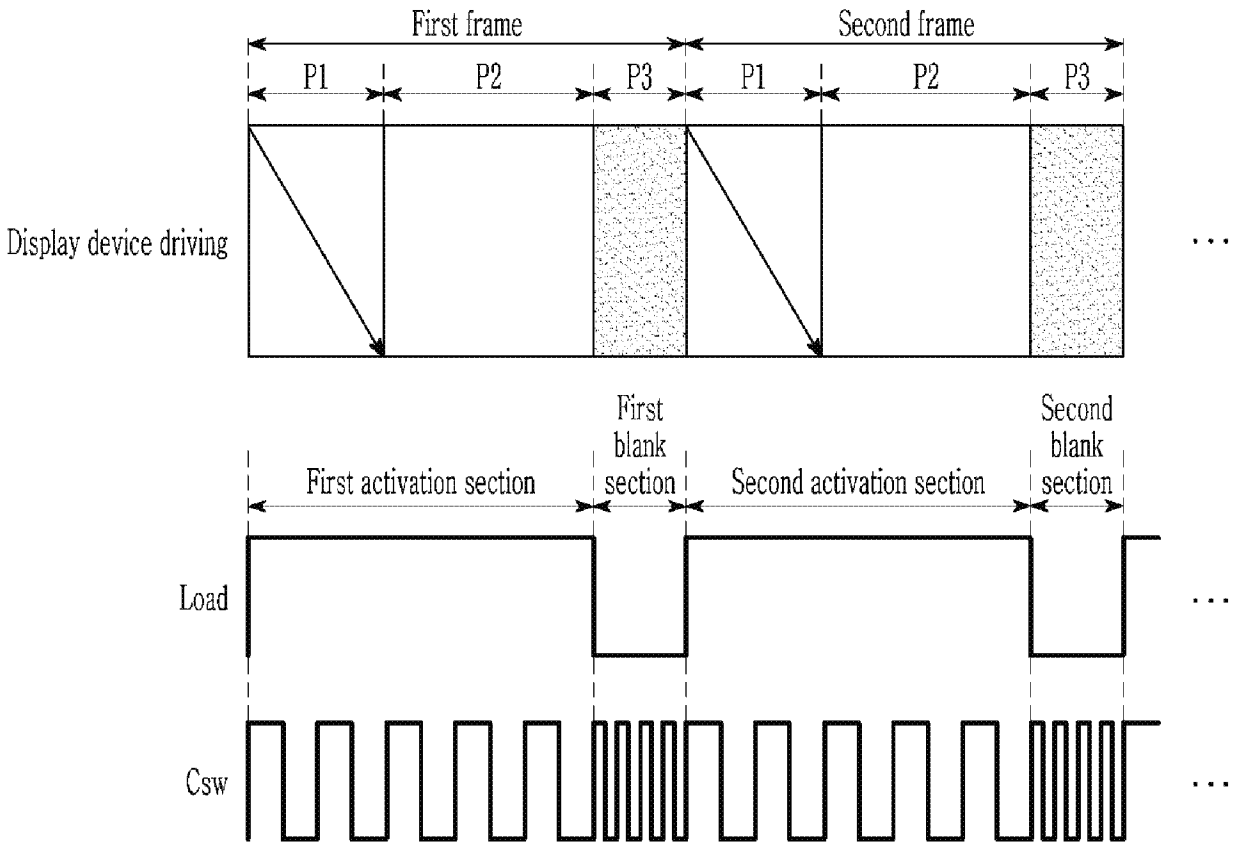
FIG. 4 is a view showing a driving method of a display device according to an exemplary embodiment of the inventive concept.

FIG. 4 is a view showing a driving method of a display device according to an exemplary embodiment of the inventive concept.

Referring to FIG. 1 and FIG. 4, the display device 10 displays the image in frame units. A time unit in which one image is displayed on the display device 10 is referred to as a frame. One frame may include a writing-in period P1, a light emission period P2, and a reset period P3.

During the writing-in period P1, the plurality of data signals data[1]-data[m] are input to the plurality of pixels PX. During the writing-in period P1, the scan driver 200 may sequentially apply the scan signals S[1]-S[n] having the gate-on voltage to the plurality of scan lines, and the data driver 300 may apply the data signals data[1]-data[m] to the plurality of data lines in correspondence with the scan signals S[1]-S[n].

During the light emission period P2, the plurality of pixels PX are emitted with a brightness corresponding to the input data signals data[1]-data[m]. During the light emission period P2, the first driving voltage VDD1 may provide the driving current for the emission of the plurality of pixels PX.

During the reset period P3 subsequent to the light emission period P2, the plurality of pixels PX are reset to a 0 gray. In other words, the reset period P3 is a period in which the image is not displayed.

A section in which the display device 10 is driven for displaying the image of one frame is referred to as an activation section, and the activation section may include the writing-in period P1 and the light emission period P2. During the activation section, the load of the display device 10 increases, resulting in a heavy load.

The section in which the image is not displayed between the images of continuous frames is referred to as a blank section. The blank section may include the reset period P3. During the blank section, the load of the display device 10 drops to almost zero, resulting in a light load.

As described above, when the load of the display device 10 is changed into the heavy load and the light load in each frame unit, the power supply unit 400 may change the frequency of the ramp pulse (e.g., the switch control signal Csw) based on the load of the display device 10.

For example, in the continuous first frame and second frame, a first blank section is disposed between a first activation section of the first frame and a second activation section of the second frame. A second blank section is located next to the second activation section. During the first activation section and the second activation section, the load of the display device 10 becomes the heavy load, and the load of the display device 10 becomes the light load during the first blank section and the second blank section. The power supply unit 400 outputs the switch control signal Csw (e.g., the ramp pulse) having the low frequency during the first activation section and the second activation section. Additionally, the power supply unit 400 outputs the switch control signal Csw (e.g., the ramp pulse) having the high frequency during the first blank section and the second blank section.

When the load of the display device 10 in the first activation section and the load of the display device 10 in the second activation section are substantially the same, since the current amounts flowing through the switch S1 are substantially the same, the frequencies of the switch control signal Csw become substantially equal to one another in the first activation section and the second activation section. Additionally, the load of the display device 10 in the first blank section and the second blank section is approximately equal to zero, and thus the frequency of the switch control signal Csw in the first blank section and the second blank section may substantially be the same.

The duty of the switch control signal Csw in the activation section is substantially the same as the duty of the switch control signal Csw in the blank section, while the frequency of the switch control signal Csw in the activation section is different from the frequency of the switch control signal Csw in the blank section. Therefore, during the activation section and the blank section, the first through fourth driving voltages VDD1, VDD2, VDD3, and VDD4 do not change.

Next, a driving method of the display device according to an exemplary embodiment of inventive concept is described with reference to FIG. 1 and FIG. 5. Differences with respect to the exemplary embodiment of FIG. 4 will be mainly described.

Figure 5:
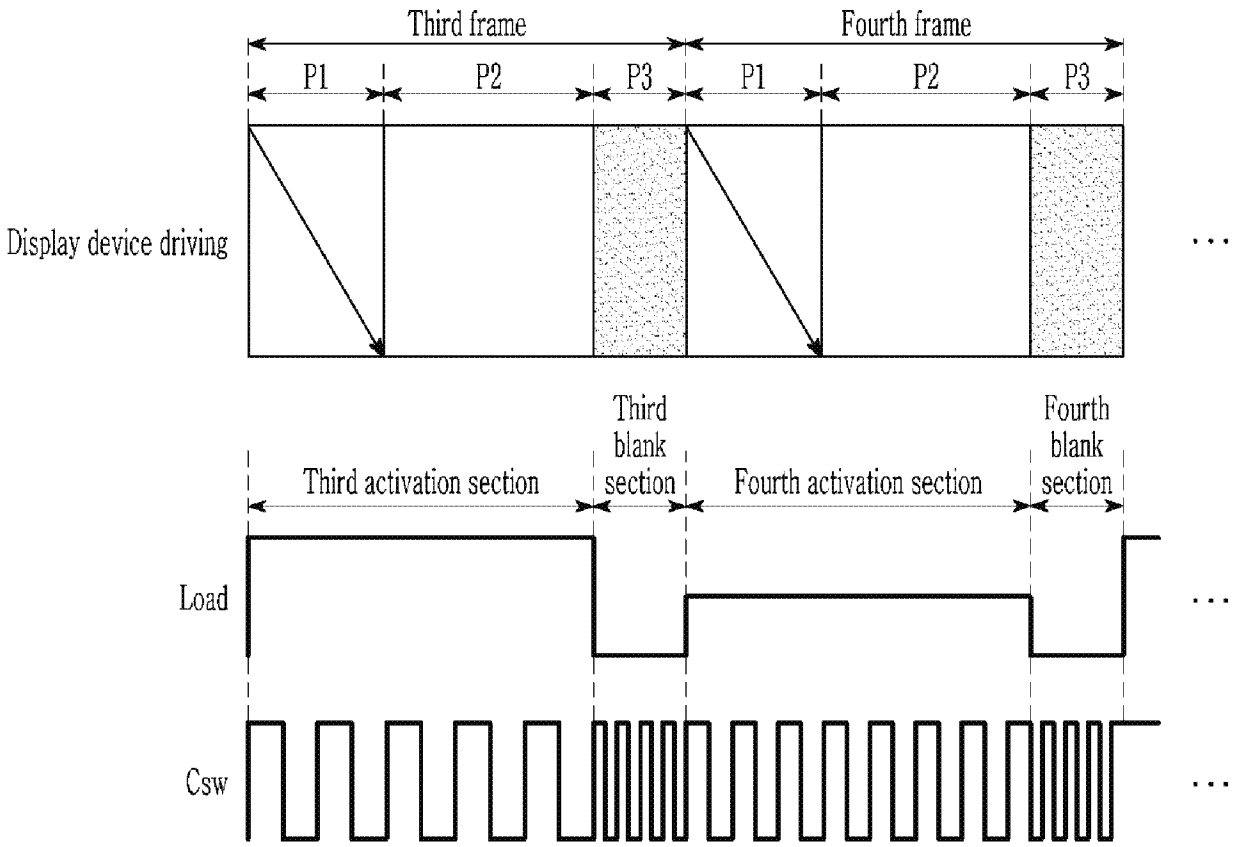
FIG. 5 is a view showing a driving method of a display device according to an exemplary embodiment of the inventive concept.

FIG. 5 is a view showing a driving method of a display device according to an exemplary embodiment of the inventive concept.

Referring to FIG. 1 and FIG. 5, the display device 10 can display a low luminance image overall. In this case, the load of the display device 10 may be an intermediate load that is smaller than the heavy load and larger than the light load. When the load of the display device 10 becomes the intermediate load, the power supply unit 400 may output the switch control signal Csw (e.g., the ramp pulse) having a frequency (e.g., the third frequency) that is higher than the frequency (e.g., the first frequency) corresponding to the heavy load and lower than the frequency (e.g., the second frequency) corresponding to the light load. The heavy load may be referred to as a first load, the light load may be referred to as a second load, and the intermediate load may be referred to as a third load. Thus, the first load is greater than the second load. The third load is smaller than the first load and larger than the second load.

For example, in successive third and fourth frames, a third blank section is disposed between a third activation section of the third frame and a fourth activation section of the fourth frame, and a fourth blank section is disposed subsequent to the fourth activation section. During the third activation section, while the load of the display device 10 becomes the heavy load, the load of the display device 10 during the fourth activation section may become the intermediate load. The power supply unit 400 may output the switch control signal Csw having the low frequency during the third activation section and may output the switch control signal Csw having the intermediate frequency during the fourth activation section.

For example, during the third activation section, the load of the display device 10 corresponds to the first reference value REF1 of FIG. 3 such that the ramp pulse having the frequency corresponding to the first reference value REF1 may be output, during the fourth activation section, the load of the display device 10 corresponds to the second reference value REF2 of FIG. 3 such that the ramp pulse having the frequency corresponding to the second reference value REF2 may be output, and during the third and fourth blank sections, the load of the display device 10 corresponds to the third reference value REF3 of FIG. 3 such that the ramp pulse having the frequency corresponding to the third reference value REF3 may be output.

In other words, in the activation section of the plurality of frames, the loads of the display device 10 may be different from one another, and in this case, the frequencies of the switch control signal Csw (e.g., the ramp pulse) may be different from one another in the activation section of the plurality of frames. Although the frequencies of the switch control signal Csw are different from one another, the duty of the switch control signal Csw is the same.

Except for these differences, the features of the exemplary embodiment described with reference to FIG. 1 and FIG. 4 may all be applied to the exemplary embodiment described with reference to FIG. 1 and FIG. 5, and thus redundant descriptions between the illustrated exemplary embodiments are omitted.

Next, a driving voltage generator according to exemplary embodiments of the inventive concept is described with reference to FIG. 6 to FIG. 8. The differences from the above-described exemplary embodiment in FIG. 1 to FIG. 5 are mainly described.

FIG. 6 is a view showing a driving voltage generator according to an exemplary embodiment of the inventive concept.

Referring to FIG. 6, the second driving voltage generator 420 includes the pulse generator 4111 receiving the current flowing to the driving voltage output terminal OUT1. In other words, the pulse generator 4111 receives the current flowing to the driving voltage output terminal OUT1 without receiving the current flowing through the switch S1. In other words, the ramp pulse generator 4115 of FIG. 3 receives the current flowing to the driving voltage output terminal OUT1 by the input terminal INp.

The pulse generator 4111 may compare the current flowing to the driving voltage output terminal OUT1 with the plurality of reference values REF1, REF2, REF3, . . . to select the reference value corresponding to the current flowing to the driving voltage output terminal OUT1, and may output the ramp pulse having the frequency corresponding to the selected reference value to the adder 4113.

The switch controller 411 may change the frequency of the switch control signal Csw by changing and outputting the frequency of the ramp pulse based on the current flowing to the driving voltage output terminal OUT1. When the value of the current flowing to the driving voltage output terminal OUT1 is large (e.g., the load is large), the switch controller 411 may output the ramp pulse having the relatively low frequency. Additionally, when the value of the current flowing to the driving voltage output terminal OUT1 is small (e.g., the load is small), the switch controller 411 may output the ramp pulse having the relatively high frequency.

Except for these differences, the features of the exemplary embodiment described with reference to FIG. 1 to FIG. 5 may all be applied to the exemplary embodiment described with reference to FIG. 6, and thus redundant descriptions between the illustrated exemplary embodiments are omitted.

FIG. 7 shows a driving voltage generator according to an exemplary embodiment of the inventive concept. The differences from the above-described exemplary embodiment of FIG. 1 to FIG. 5 are mainly described.

Referring to FIG. 7, the third driving voltage generator 430 includes the pulse generator 4111 receiving the voltage output from the current measuring unit 4112. In other words, the pulse generator 4111 receives the voltage output from the current measuring unit 4112 without receiving the current flowing through the switch S1. The voltage output from the current measuring unit 4112 may have the voltage value corresponding to the current flowing through the switch S1. In other words, in FIG. 3, the ramp pulse generator 4115 receives the voltage output from the current measuring unit 4112 by the input terminal INp.

The pulse generator 4111 may compare the voltage output from the current measuring unit 4112 with the plurality of reference values REF1, REF2, REF3, . . . to select the reference value corresponding to the voltage output from the current measuring unit 4112, and may output the ramp pulse having the frequency corresponding to the selected reference value to the adder 4113.

The switch controller 411 may change the frequency of the switch control signal Csw by changing and outputting the frequency of the ramp pulse based on the value of the voltage output from the current measuring unit 4112. When the voltage output from the current measuring unit 4112 is large (e.g., the load is large), the switch controller 411 may output the ramp pulse having the relatively low frequency. Additionally, when the voltage output from the current measuring unit 4112 is small (e.g., the load is small), the switch controller 411 may output the ramp pulse having the relatively high frequency.

Except for these differences, the features of the exemplary embodiment described with reference to FIG. 1 to FIG. 5 may all be applied to the exemplary embodiment described with reference to FIG. 7, and thus redundant descriptions between the illustrated exemplary embodiments are omitted.

FIG. 8 is a view showing a driving voltage generator according to an exemplary embodiment of the inventive concept. The differences from the above-described FIG. 1 to FIG. 5 are mainly described.

Referring to FIG. 8, the fourth driving voltage generator 440 includes the pulse generator 4111 receiving the vertical synchronization signal Vsync input to a second input terminal IN2. In other words, the pulse generator 4111 receives the vertical synchronization signal Vsync without receiving the current flowing through the switch S1. In other words, in FIG. 3, the ramp pulse generator 4115 receives the vertical synchronization signal Vsync by the input terminal INp. The vertical synchronization signal Vsync is a signal dividing the image into frame units. In this case, the ramp pulse generator 4115 may output the ramp pulse having the relatively low frequency during a predetermined first section (e.g., the activation section) from the time at which the vertical synchronization signal Vsync is received as the on voltage without using the plurality of reference values REF1, REF2, REF3, . . . . Additionally, the ramp pulse generator 4115 may output the ramp pulse having the relatively high frequency during a predetermined second section (e.g., the blank section) next to the first section. In other words, the pulse generator 4111 may output the ramp pulse having the low frequency to the adder 4113 during the first section based on the vertical synchronization signal Vsync, and may output the ramp pulse having the high frequency during the second section to the adder 4113.

The switch controller 411 may change the frequency of the switch control signal Csw by changing and outputting the frequency of the ramp pulse according to the vertical synchronization signal Vsync. The switch controller 411 may output the ramp pulse having the relatively low frequency to the first section (e.g., the activation section) in which the load is large according to the vertical synchronization signal Vsync. Additionally, the switch controller 411 may output the ramp pulse having the relatively high frequency to the second section (e.g., the blank section) in which the load is small.

Except for these differences, the features of the exemplary embodiment described with reference to FIG. 1 to FIG. 5 may all be applied to the exemplary embodiment described with reference to FIG. 8, and thus redundant descriptions between the illustrated exemplary embodiments are omitted.

Thus, in a display device, a power supply device for the display device, and a driving method of the display device according to exemplary embodiments of the inventive concept, a driving voltage corresponding to a driving stage of the display device may be more effectively generated.

While the inventive concept has been shown and described with reference to exemplary embodiments thereof, it will be apparent to those of ordinary skill in the art that various modifications in form and details may be made thereto without materially departing from the spirit and scope of the inventive concept as set forth by the following claims.

What is claimed is:

1. A display device comprising:

a display unit including a plurality of pixels;

a scan driver configured to apply a scan signal to a plurality of scan lines connected to the plurality of pixels;

a data driver configured to apply a data signal to a plurality of data lines connected to the plurality of pixels; and a power supply unit configured to supply a driving voltage to at least one among the display unit, the scan driver, and the data driver, wherein the power supply unit includes:

an inductor connected between an input terminal to which an input voltage is input and a driving voltage output terminal to which the driving voltage is output;

a switch connected between the inductor and a ground; and a switch controller configured to output a first ramp pulse having a first frequency at a first load of the display device and output a second ramp pulse having a second frequency at a second load of the display device to control a switching operation of the switch, wherein the first frequency is lower than the second frequency, the first load is greater than the second load, and the switch controller includes a pulse generator configured to receive a current flowing through the switch and output a ramp pulse having a frequency corresponding to the received current.

2. The display device of claim 1, wherein the pulse generator compares the received current with a plurality of reference values to select a reference value corresponding to the received current, and outputs the ramp pulse having a frequency corresponding to the selected reference value.

3. The display device of claim 1, wherein the switch controller further includes:

a current measuring unit configured to measure the current flowing through the switch and output a voltage corresponding to the measured current; and an adder configured to add the voltage output from the current measuring unit to the ramp pulse output from the pulse generator.

4. The display device of claim 1, wherein:

a frame in which one image is displayed includes a writing-in period in which a data signal is input to the plurality of pixels, a light emission period in which the plurality of pixels are emitted, and a reset period in which the plurality of pixels are reset, the display device has the first load during an activation section including the writing-in period and the light emission period; and the display device has the second load during a blank section including the reset period.

5. The display device of claim 4, wherein when the display device has a third load that is smaller than the first load and is larger than the second load during the activation section, the switch controller outputs a third ramp pulse having a third frequency that is higher than the first frequency and is lower than the second frequency to control the switching operation of the switch.

6. A display device, comprising:

a display unit including a plurality of pixels;

a scan driver configured to apply a scan signal to a plurality of scan lines connected to the plurality of pixels;

a data driver configured to apply a data signal to a plurality of data lines connected to the plurality of pixels; and a power supply unit configured to supply a driving voltage to at least one among the display unit, the scan driver, and the data driver, wherein the power supply unit includes:

an inductor connected between an input terminal to which an input voltage is input and a driving voltage output terminal to which the driving voltage is output;

a switch connected between the inductor and a ground; and a switch controller configured to output a first ramp pulse having a first frequency at a first load of the display device and output a second ramp pulse having a second frequency at a second load of the display device to control a switching operation of the switch, wherein the first frequency is lower than the second frequency, and the first load is greater than the second load, wherein the switch controller includes:

a current measuring unit configured to measure a current flowing through the switch and output a voltage corresponding to the measured current; and a pulse generator configured to receive the voltage output from the current measuring unit and output a ramp pulse having a frequency corresponding to the received voltage.

7. A power supply device for a display device comprising:

an inductor connected between an input terminal to which an input voltage is input and a driving voltage output terminal to which a driving voltage is output;

a switch connected between the inductor and a ground; and a switch controller controlling a switching operation of the switch, wherein the switch controller outputs a first ramp pulse having a first frequency to control the switching operation of the switch during an activation section including a writing-in period in which a data signal is input to a plurality of pixels and a light emission period in which the plurality of pixels are emitted in a frame in which the display device displays one image, the switch controller outputs a second ramp pulse having a second frequency to control the switching operation of the switch during a blank section including a reset period in which the plurality of pixels are reset in the frame, the first frequency is lower than the second frequency, and the switch controller includes a pulse generator configured to receive a current flowing through the switch and output a ramp pulse having a frequency corresponding to the received current.

8. The power supply device for the display device of claim 7, wherein the switch controller includes:

a current measuring unit configured to measure a current flowing through the switch and output a voltage corresponding to the measured current; and an adder configured to add the voltage output from the current measuring unit to the ramp pulse output from the pulse generator.

9. A power supply device for a display device, comprising:

an inductor connected between an input terminal to which an input voltage is input and a driving voltage output terminal to which a driving voltage is output;

a switch connected between the inductor and a ground; and a switch controller controlling a switching operation of the switch, wherein the switch controller outputs a first ramp pulse having a first frequency to control the switching operation of the switch during an activation section including a writing-in period in which a data signal is input to a plurality of pixels and a light emission period in which the plurality of pixels are emitted in a frame in which the display device displays one image, the switch controller outputs a second ramp pulse having a second frequency to control the switching operation of the switch during a blank section including a reset period in which the plurality of pixels are reset in the frame, and the first frequency is lower than the second frequency, wherein the switch controller includes:

a current measuring unit configured to measure a current flowing through the switch and output a voltage corresponding to the measured current; and a pulse generator configured to receive the voltage output from the current measuring unit and output the ramp pulse having a frequency corresponding to the received voltage.

10. A driving method of a display device including a power supply unit including an inductor connected between an input terminal to which an input voltage is input and a driving voltage output terminal to which a driving voltage is output, a switch connected between the inductor and a ground, and a switch controller configured to control a switching operation of the switch, comprising:

inputting a data signal to a plurality of pixels during a writing-in period;

emitting the plurality of pixels with a brightness corresponding to the input data signal during a light emission period; and resetting the plurality of pixels during a reset period, wherein the switch controller outputs a first ramp pulse having a first frequency to control the switching operation of the switch during an activation section including the writing-in period and the light emission period, the switch controller outputs a second ramp pulse having a second frequency to control the switching operation of the switch during a blank section including the reset period, the first frequency is lower than the second frequency, and the switch controller receives a current flowing through the switch and outputs a ramp pulse having a frequency corresponding to the received current.

11. A driving method of a display device including a power supply unit including an inductor connected between an input terminal to which an input voltage is input and a driving voltage output terminal to which a driving voltage is output, a switch connected between the inductor and a ground, and a switch controller configured to control a switching operation of the switch, comprising:

inputting a data signal to a plurality of pixels during a writing-in period;

emitting the plurality of pixels with a brightness corresponding to the input data signal during a light emission period; and resetting the plurality of pixels during a reset period, wherein the switch controller outputs a first ramp pulse having a first frequency to control the switching operation of the switch during an activation section including the writing-in period and the light emission period, the switch controller outputs a second ramp pulse having a second frequency to control the switching operation of the switch during a blank section including the reset period, the first frequency is lower than the second frequency, and the switch controller measures a current flowing through the switch, outputs a voltage corresponding to the measured current, and outputs a ramp pulse having a frequency corresponding to the output voltage.

* * * * *